US005905928A

United States Patent [19]

Shin

[11] Patent Number: 5,905,928

[45] Date of Patent: May 18, 1999

[54] CARRIER RECOVERY APPARATUS OF LIQUID ELECTROPHOTOGRAPHIC PRINTER

[75] Inventor: Seong-soo Shin, Yongin, Rep. of Korea

[73] Assignee: Samsung Electronics Co., Ltd., Kyungki-do, Rep. of Korea

[21] Appl. No.: 09/097,701

[22] Filed: Jun. 16, 1998

[30] Foreign Application Priority Data

Dec. 27, 1997 [KR] Rep. of Korea ..... 97-74985

[51] Int. Cl.[6] ..... G03G 15/10

[52] U.S. Cl. ..... 399/250; 55/505; 95/260; 96/219

[58] Field of Search ..... 399/93, 98, 249, 399/250, 251; 55/505; 95/260; 96/219; 396/565, 579, 626; 355/27, 29

[56] References Cited

U.S. PATENT DOCUMENTS 4,473,282 9/1984 Michlin ..... 396/579

5,737,674 4/1998 Venkatesan et al. ..... 399/250

*Primary Examiner*—William Royer
*Assistant Examiner*—William A. Noē
*Attorney, Agent, or Firm*—Sughrue, Mion, Zinn, Macpeak & Seas, PLLC

[57] ABSTRACT

A carrier recovery apparatus of a liquid electrophotographic printer includes a condenser for condensing a gas carrier recovered from a photoreceptor belt, a filtering tube having a cavity, whose first end is connected to the condenser, and whose second end has a plurality of throughholes leading to the cavity radially formed thereat, a filter bonded on the outer surface of the filtering tube and which filters the gas carrier contained in air passing through the throughholes, and an exhaust tube having an internal diameter larger than the outer diameter of the filtering tube, and whose first end is tightly fitted to the second end of the filtering tube to which the filter is coupled, for exhausting the air to the outside.

3 Claims, 5 Drawing Sheets

CARRIER RECOVERY APPARATUS OF LIQUID ELECTROPHOTOGRAPHIC PRINTER

BACKGROUND OF THE INVENTION

1. Field of the Invention

The present invention relates to a liquid electrophotographic printer, and more particularly, to an apparatus for recovering a liquid carrier contained in a developer liquid supplied to a photoreceptor belt.

2. Description of the Related Art

An electrophotographic printer such as a laser color printer supplies a developer liquid in which a toner is mixed with a liquid carrier such as NORPAR, commercially available from Exxon, to an electrostatic latent image formed on a photoreceptor belt, and develops the electrostatic latent image. The carrier is then recovered by a carrier recovery apparatus.

FIG. 1 shows a carrier recovery apparatus employed in a conventional liquid electrophotographic printer. Referring to FIG. 1, in a manifold 21, there are provided a drying roller 22 for absorbing the liquid carrier from a photoreceptor belt 14 while rotating in contact with the photoreceptor belt 14, and a heating roller 23 for heating the drying roller in contact therewith and evaporating the absorbed carrier.

The evaporated gas carrier is accommodated within the manifold 21. Since a multitude of heat exchanging fins (not shown) are formed on the outer surface of the manifold 21, the gas carrier is condensed on the inner surface of the manifold 21 by heat exchange. The condensed liquid carrier is collected from the inner surface of the manifold 21 to then be induced to a cartridge 26 through a first recovery tube 25.

Further, the uncondensed gas carrier of the manifold 21 is induced to a condenser 28 along a supply line 27 by the driving of a supply fan 29. Since a liquid condensed carrier 28*a* is contained in the condenser 28, the induced gas carrier is liquefied by the heat exchange with the condensed carrier 28*a*. Then, the condensed liquid carrier is recovered in the cartridge 26 through a second recovery tube 31.

Also, the gas carrier which is not condensed in the condenser 28 is filtered via a filter 34 made of active carbon, together with the air exhausted by an exhaust fan 33 to the outside.

Reference numeral 30 represents a peltier chip for keeping the internal temperature of the condenser 28 constant, and reference numeral 32 represents a moisture reservoir, for separating moisture from the liquid carrier 28*a* stored in the condenser 28 and storing the same.

Since NORPAR, which is typically used as the carrier is an environmentally hazardous material, it is necessary to prevent the carrier from being effused.

Therefore, in order to increase the filtering capacity of the filter 34, the thickness (T) of the filter 34 must be large. In this case, the exhausting capacity of the exhaust fan 33 is noticeably reduced. To solve this problem, a large exhaust fan and a driver therefor (not shown) are employed. However, the overall structure of the printer becomes bulky.

SUMMARY OF THE INVENTION

To solve the above problem, it is an objective of the present invention to provide a carrier recovery apparatus of a liquid electrophotographic printer, having an improved capability of filtering a carrier without adversely affecting the exhausting efficiency of an exhaust fan.

Accordingly, to achieve the above objective, there is provided a carrier recovery apparatus of a liquid electrophotographic printer comprising: a condenser for condensing a gas carrier recovered from a photoreceptor belt; a filtering tube having a cavity, whose first end is connected to the condenser, and whose second end has a plurality of throughholes leading to the cavity radially formed thereat; a filter bonded on the outer surface of the filtering tube and filtering the gas carrier contained in the air passing through the throughholes; and an exhaust tube having an internal diameter larger than the outer diameter of the filtering tube, and whose first end is tightly fitted to the second end of the filtering tube to which the filter is coupled, for exhausting the air to the outside.

Also, according to another aspect of the present invention, there is provided a carrier recovery apparatus of a liquid electrophotographic printer comprising: a condenser for condensing a gas carrier recovered from a photoreceptor belt; a filtering tube having a cavity and whose first end is connected to the condenser; an exhaust tube having an outer diameter smaller than the internal diameter of the filtering tube, whose first end has a plurality of throughholes radially formed thereat and is tightly fitted to a second end of the filtering tube so that the throughholes lead to the cavity of the filtering tube; and a filter bonded on the outer surface of the first end of the filtering tube having the throughholes, for removing the gas carrier contained in the air exhausted through the throughholes.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
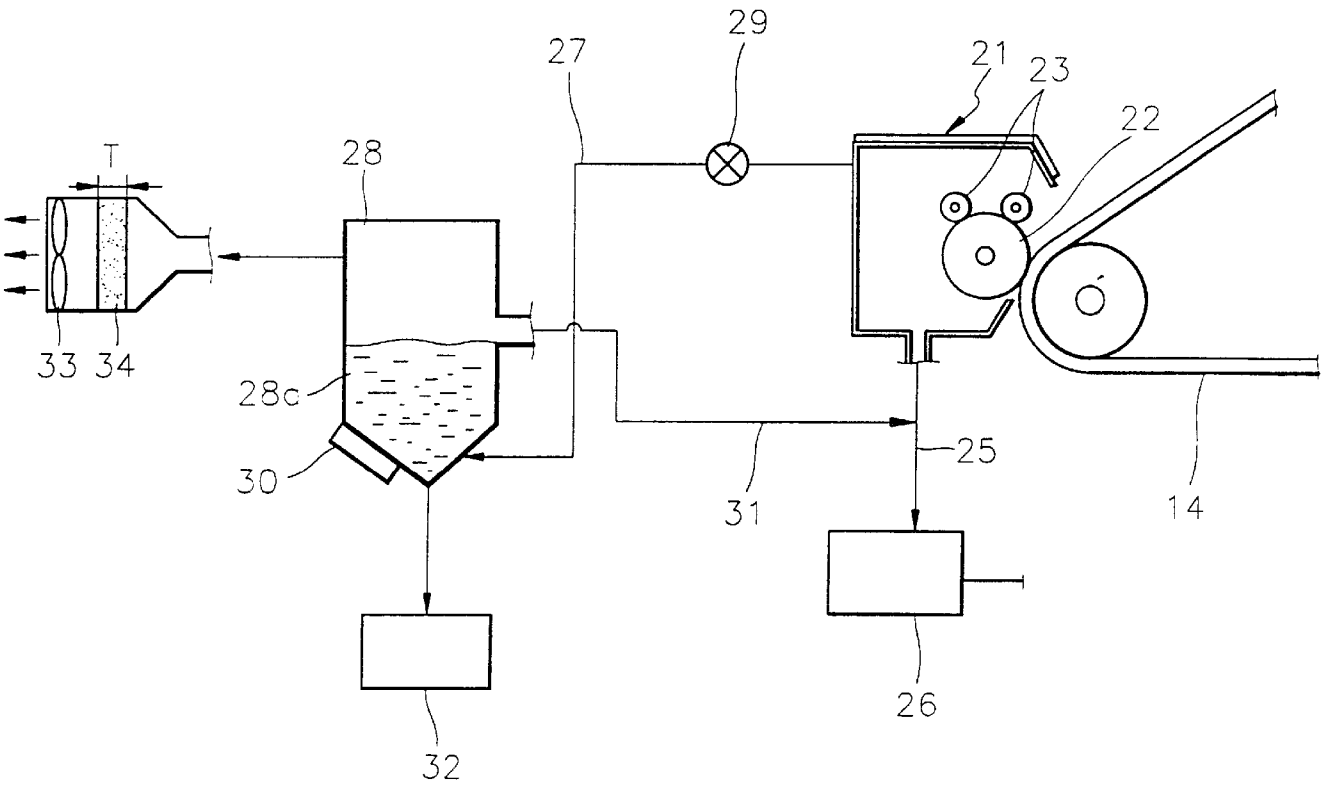
FIG. 1 (PRIOR ART)
FIG. 1 is a schematic diagram of a carrier recovery apparatus for a conventional liquid electrophotographic printer.
Figure 2:
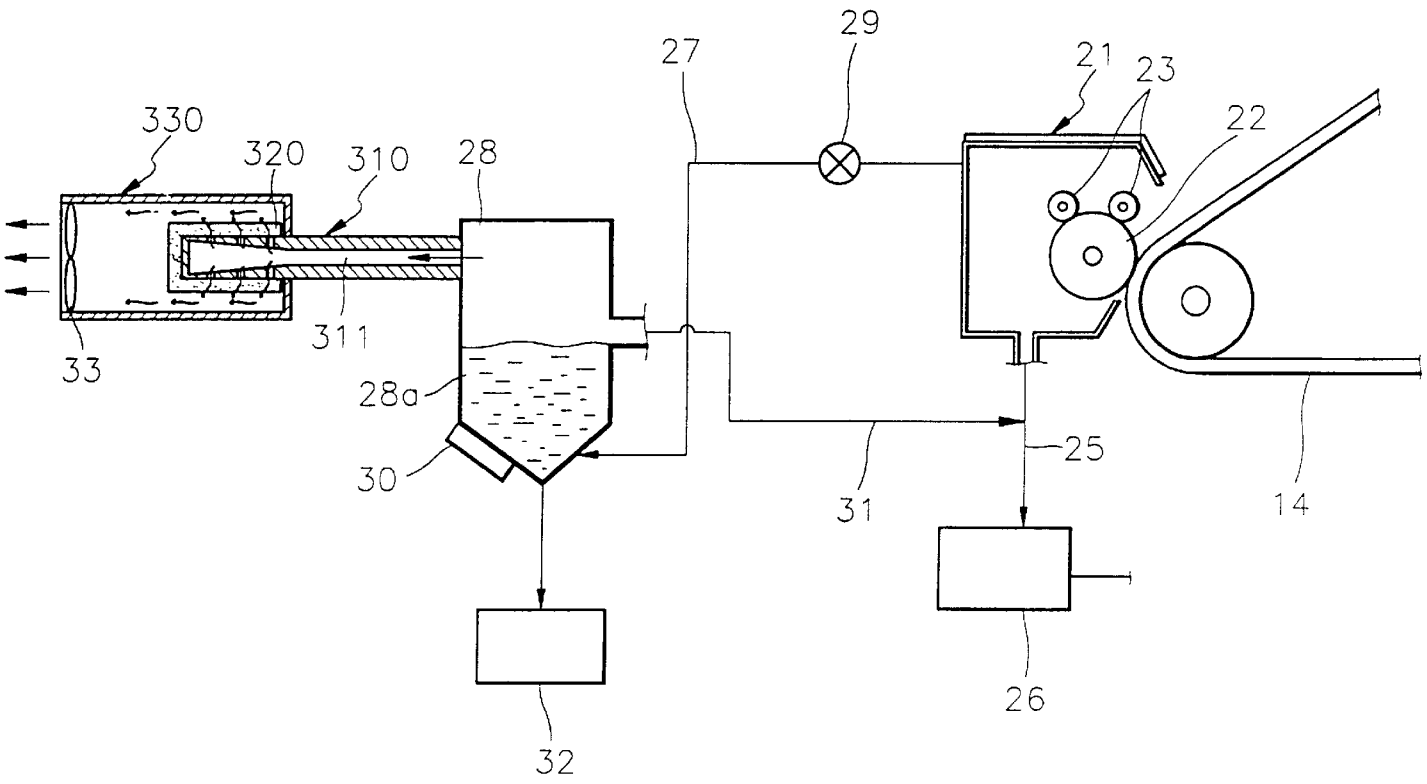
FIG. 2 is a schematic diagram of a carrier recovery apparatus according to an embodiment of the present invention.

In FIG. 2 showing a carrier recovery apparatus according to an embodiment of the present invention, the elements corresponding to those in FIG. 1 are designated by the same reference numerals.

Referring to FIG. 2, in a manifold 21, there are provided a drying roller 22 for absorbing a liquid carrier from the photoreceptor belt 14 and a heating roller 23 for evaporating the absorbed carrier. The evaporated gas carrier is accommodated within the manifold 21, and supplied to a condenser 28 to then be condensed. Gas carrier that is not condensed in the condenser 28 is filtered by filtering means.

Figure 3:
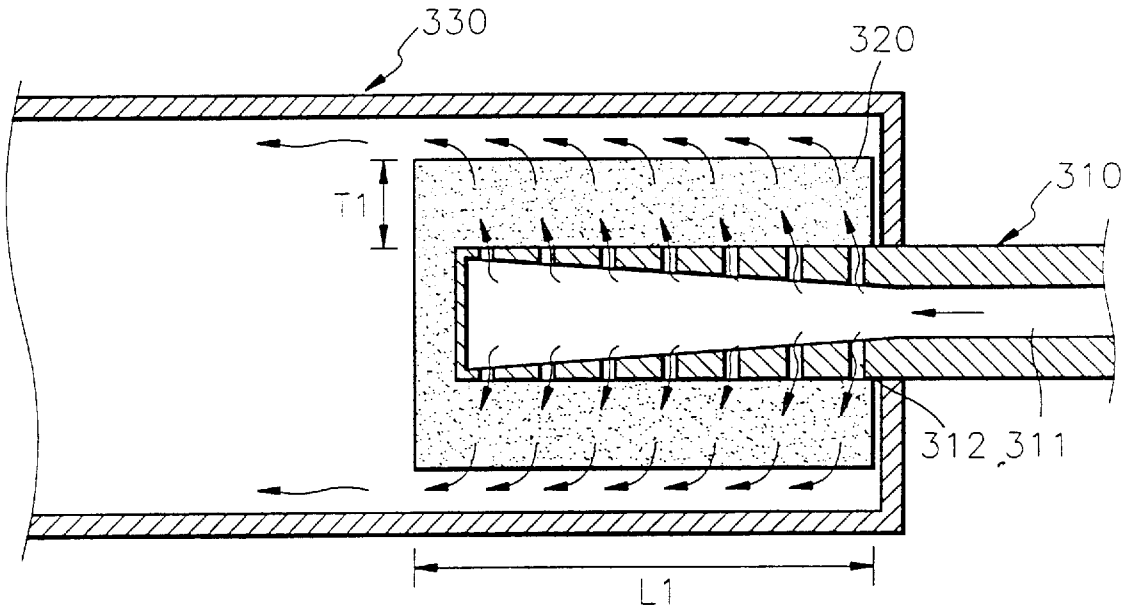
FIG. 3 is an enlarged view of a portion of a carrier recovery apparatus for a liquid electrophotographic printer shown in FIG. 2.
Figure 4:
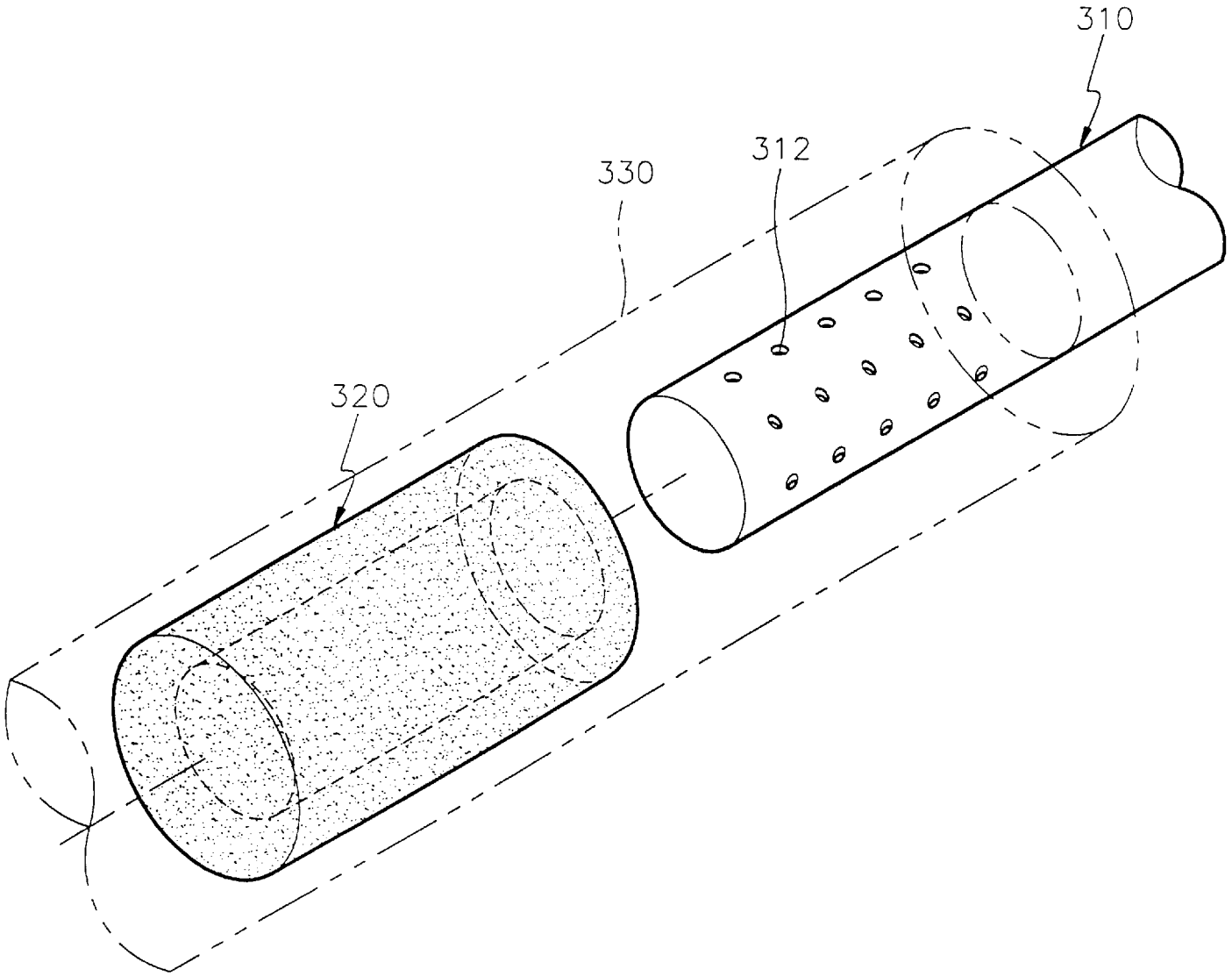
FIG. 4 is a schematic perspective view illustrating a filtering tube and an exhaust line shown in FIG. 2.

As shown in FIGS. 2 through 4, the filtering means includes a filtering tube 310 having a cavity 311 for sucking air from the condenser 28. A first end of the filtering tube 310 is connected to the condenser 28, and a plurality of throughholes 312 leading to the cavity 311 are formed in a radial direction at a second end of the filtering tube 310. Here, the cavity 311 is formed such that its diameter gradually increases toward its second end, along the traveling direction of the air. The gradual diameter increase is for evenly distributing the exhaustion of air throughout all the throughholes 312, from the ones closer to the condenser 28, to the ones farthest from the condenser 28.

A filter 320 for filtering the air exhausted through the throughholes 312 is installed on the outer surface of the filtering tube 310. Also, the second end of the filtering tube 310 is tightly fitted by an exhaust tube 330 having an internal diameter larger than the outer diameter of the filtering tube 310. An exhaust fan 33 for exhausting the air to the outside is installed at the outlet of the exhaust tube 330.

In the aforementioned configuration, when the exhaust fan 33 operates, air is induced from the condenser 28 to the filtering tube 310. Here, the gas carrier not having been condensed in the condenser 28 is contained in the air. While the induced air passes the filter 320 via the throughholes 312 formed at the second end of the filtering tube 310, the gas carrier contained in the induced air is filtered. The air passing the filter 320 is exhausted to the outside along the exhaust tube 330.

According to this embodiment, the load applied to the exhaust fan 33 is noticeably proportional to the thickness (T1) of the filter 320. That is to say, even when the length (L1) of the filter 320 is increased, the load applied to the exhaust fan 33 is not noticeably increased. Therefore, it is possible to enhance the filtering capacity by increasing the filtering area, by increasing the length (L1) of the filter 320.

Figure 5:
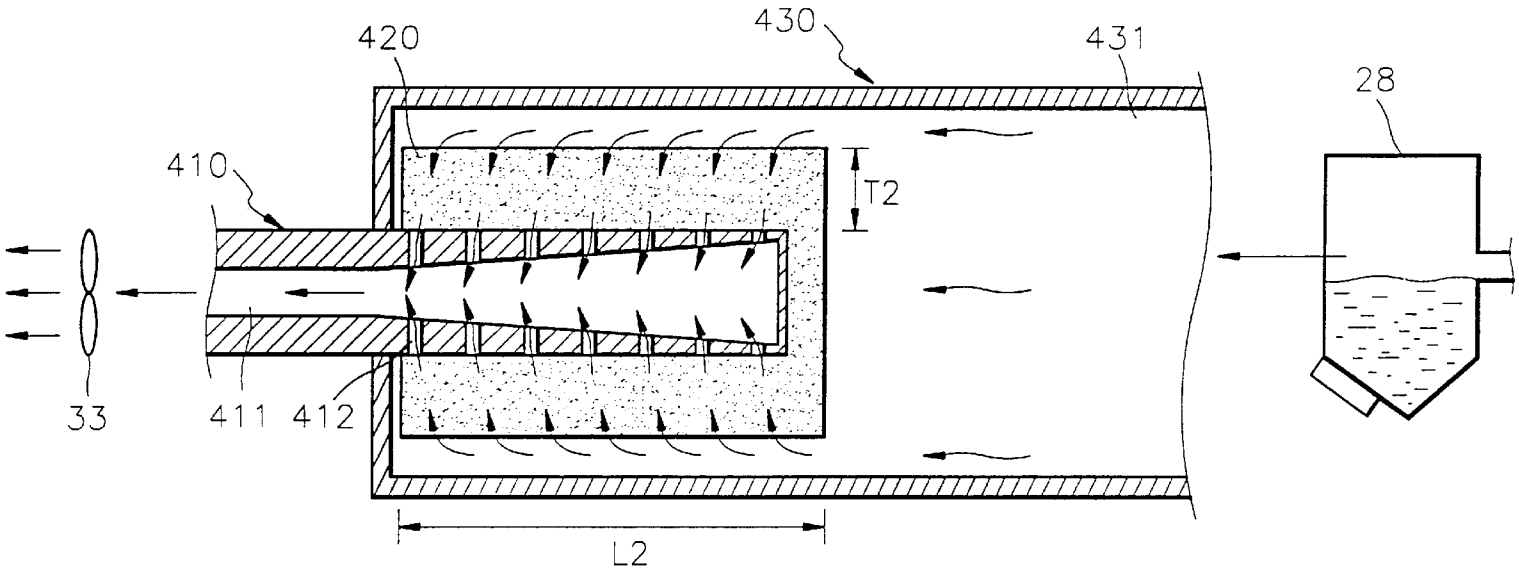
FIG. 5 is a schematic diagram of a carrier recovery apparatus according to another embodiment of the present invention.

FIG. 5 is a schematic diagram of a carrier recovery apparatus according to another embodiment of the present invention. In FIG. 5, the elements corresponding to those in the preceding drawings are designated by the same reference numerals.

According to this embodiment, the internal diameter of a filtering tube 430 whose one end is connected to the condenser 28 is larger than the outer diameter of an exhaust tube 410. A plurality of throughholes 412 leading to a cavity 411 are radially formed at a first end of the exhaust tube 410, and a filter 420 is formed on the outer surface of the exhaust tube 410. A second end of the filtering tube 430 is tightly fitted to the first end of the exhaust tube 410 having the plurality of throughholes 412.

The air induced from the condenser 28 to a cavity 431 of the filtering tube 430 passes the filter 420 and flows to the exhaust tube 410 through the throughholes 412. Here, the gas carrier contained in the air is filtered and the air passing through the filter 420 is exhausted to the outside along the cavity 411 of the exhaust tube 410.

In the same manner as the first embodiment, according to this embodiment, since the load applied to the exhaust fan 33 is noticeably proportional to the thickness (T2) of the filter 420, rather than to the length (L2) of the filter 420, it is possible to enhance the filtering capacity by increasing the air filtering area by increasing the length (L2) of the filter 420.

As described above, in the carrier recovery apparatus of a liquid electrophotographic printer, since the filtering area is increased without considerably increasing the load of an exhaust fan, the carrier filtering capability can be greatly improved.

What is claimed is:

1. A carrier recovery apparatus of a liquid electrophotographic printer comprising:

a condenser which condenses a gas carrier recovered from a photoreceptor belt;

a filtering tube having a cavity, whose first end is connected to the condenser, and whose second end has a plurality of throughholes leading to the cavity radially formed thereat;

a filter bonded on an outer surface of the filtering tube and which filters the gas carrier contained in air passing through the throughholes; and an exhaust tube having an internal diameter larger than an outer diameter of the filtering tube, and whose first end is tightly fitted to the second end of the filtering tube to which the filter is coupled, which exhausts the air to the outside.

2. The carrier recovery apparatus according to claim 1, wherein a cross section of the cavity of the filtering tube gradually increases toward the second end of the filtering tube, along a traveling direction of the air.

3. A carrier recovery apparatus of a liquid electrophotographic printer comprising:

a condenser which condenses a gas carrier recovered from a photoreceptor belt;

a filtering tube having a cavity and whose first end is connected to the condenser;

an exhaust tube having an outer diameter smaller than an internal diameter of the filtering tube, and having a first end which has a plurality of throughholes radially formed thereat and which is tightly fitted to a second end of the filtering tube so that the throughholes lead to the cavity of the filtering tube; and a filter bonded on an outer surface of the first end of the exhaust tube having the throughholes, for removing the gas carrier contained in the air exhausted through the throughholes.

* * * * *